US007438605B1

(12) United States Patent
Huang et al.

(10) Patent No.: US 7,438,605 B1
(45) Date of Patent: Oct. 21, 2008

(54) WIRE CONNECTING DEVICE

(75) Inventors: Kuan-Chih Huang, Taichung (TW); Wen-Jung Chang, Changhua-Hsien (TW)

(73) Assignee: Universal Scientific Industrial Co., Ltd, Nan-Tou Hsien (TW)

( * ) Notice: Subject to any disclaimer, the term of this patent is extended or adjusted under 35 U.S.C. 154(b) by 0 days.

(21) Appl. No.: 11/971,101

(22) Filed: Jan. 8, 2008

(51) Int. Cl.
*H01R 9/22* (2006.01)

(52) U.S. Cl. ..... 439/711; 439/724; 439/786; 174/92

(58) Field of Classification Search ..... 439/711, 439/709, 722, 724, 786, 790, 406–410; 174/92, 174/88 R, 138 F
See application file for complete search history.

(56) References Cited

U.S. PATENT DOCUMENTS 7,012,194 B1 * 3/2006 Wang ..... 174/92

* cited by examiner

*Primary Examiner*—Truc T. Nguyen
*Assistant Examiner*—Xuong Chung-Trans
(74) *Attorney, Agent, or Firm*—Amin, Turocy & Calvin, LLP

(57) ABSTRACT

A wire connecting device is adapted for connecting a plurality of wires, and includes a base seat having at least one mounting portion, a cover body coupled to the base seat and covering the mounting portion, a conducting unit, and a resilient pusher unit. The conducting unit is disposed between the base seat and the cover body, and includes at least one conductive plate that is mounted on the at least one mounting portion and that has a first through hole and at least one second through hole. Each of the first and second through holes is adapted for extension of an exposed conductor of a respective one of the wires into the corresponding first or second recess in the base seat. The resilient pusher unit is provided between the cover body and the conducting unit, and cooperates with the conducting unit to clamp the wires therebetween.

7 Claims, 8 Drawing Sheets

WIRE CONNECTING DEVICE

BACKGROUND OF THE INVENTION

1. Field of the Invention

The invention relates to a connecting device, more particularly to a wire connecting device.

2. Description of the Related Art

As shown in FIG. 1, a conventional wire connector 1 includes an upper housing body 12 formed with a plurality of first plate mounting grooves 121, a lower housing body 13 formed with a plurality of second plate mounting grooves 131 that correspond respectively to the first plate mounting grooves 121, and a plurality of conductive plates 14 mounted respectively in the first and second plate mounting grooves 121, 131. In use, two wires 11 can be connected electrically by disposing them on the lower housing body 13 with their exposed conductors 111 contacting a respective one of the conductive plates 14 on the lower housing body 13, and coupling the upper housing body 12 to the lower housing body 13 with one of the conductive plates 14 on the upper housing body 12 contacting the exposed conductors 111, such that the exposed conductors 111 of this pair of wires 11 are clamped between the two conductive plates 14 on the upper and lower housing bodies 12, 13.

However, the conventional wire connector 1 can only connect electrically the wires 11 in the abovementioned one-to-one manner and cannot connect electrically three or more wires 11 together, thereby resulting in a relatively poor flexibility in use.

SUMMARY OF THE INVENTION

Therefore, the object of the present invention is to provide a wire connecting device capable of connecting electrically a plurality of wires together.

Accordingly, a wire connecting device of the present invention is adapted for connecting electrically a plurality of wires. Each of the wires has an exposed conductor. The connecting device comprises a base seat, a cover body, a conducting unit, and a resilient pusher unit. The base seat has at least one mounting portion formed with a first recess and at least one second recess. The cover body is coupled to the base seat and covers the at least one mounting portion. The conducting unit is disposed between the base seat and the cover body, and includes at least one conductive plate that is mounted on the at least one mounting portion and that has a first through hole corresponding to the first recess and at least one second through hole corresponding to the at least one second recess of the mounting portion. Each of the first and second through holes is adapted for extension of the exposed conductor of a respective one of the wires into the corresponding one of the first and second recesses in such a manner that the at least one conductive plate is connected electrically to at least two of the wires. The resilient pusher unit is provided between the cover body and the conducting unit, and includes a plurality of pusher members, each of which extends from the cover body toward the base seat for clamping each of the wires between a respective one of the pusher members and the conducting unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
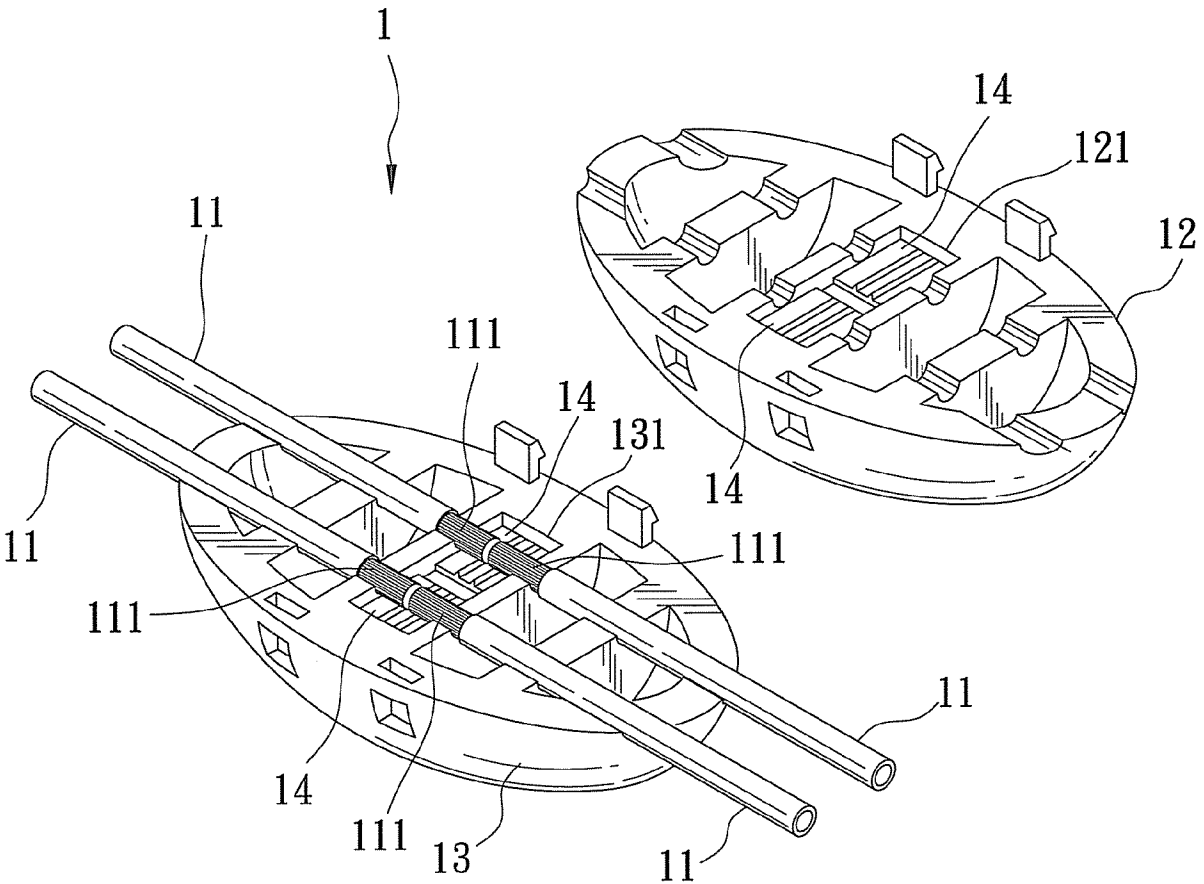
FIG. 1 PRIOR ART
FIG. 1 is a partly exploded perspective view of a conventional wire connector.

Before the present invention is described in greater detail, it should be noted that like elements are denoted by the same reference numerals throughout the disclosure.

Figure 2:
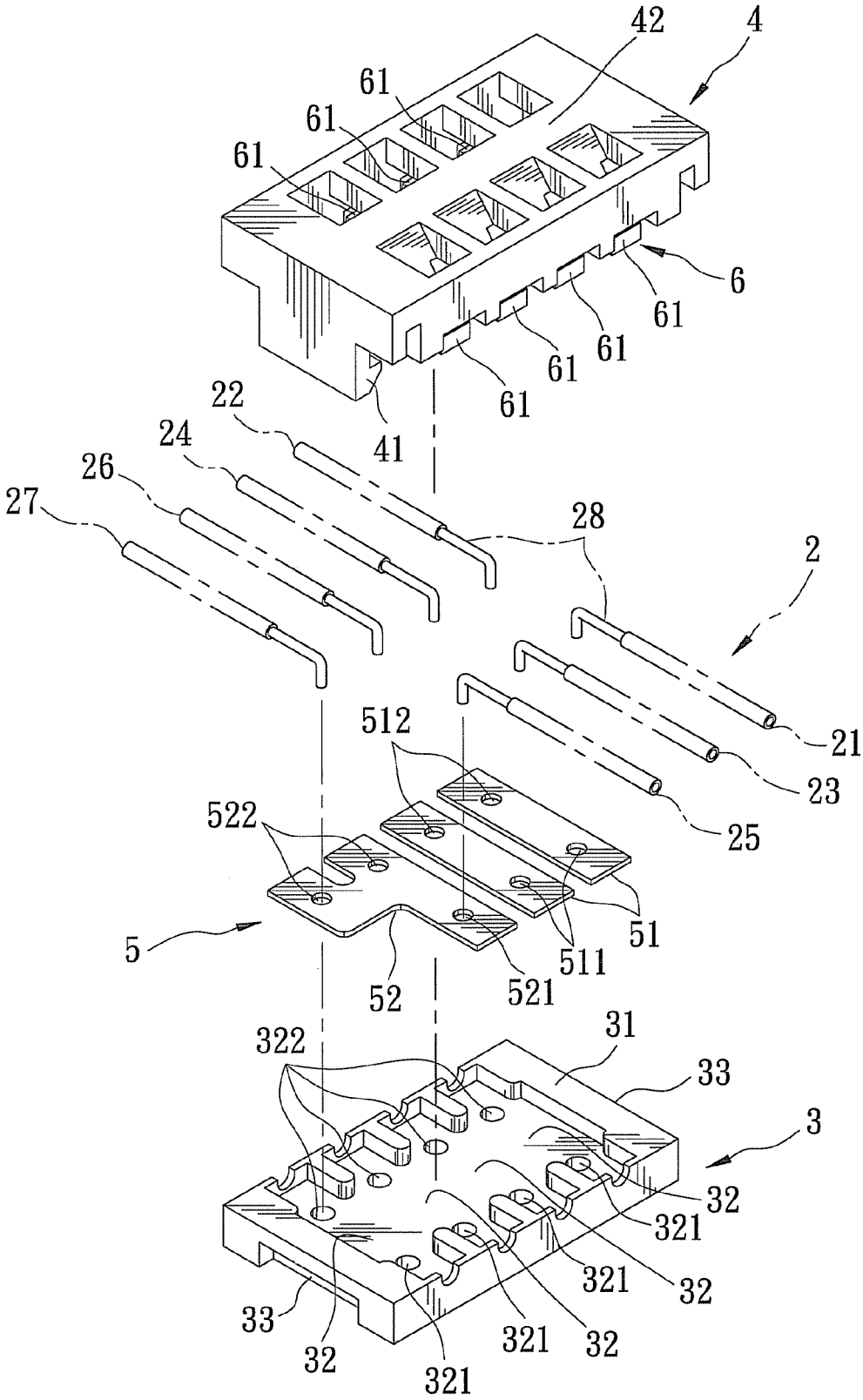
FIG. 2 is an exploded perspective view of a first preferred embodiment of a wire connecting device according to the invention.
Figure 3:
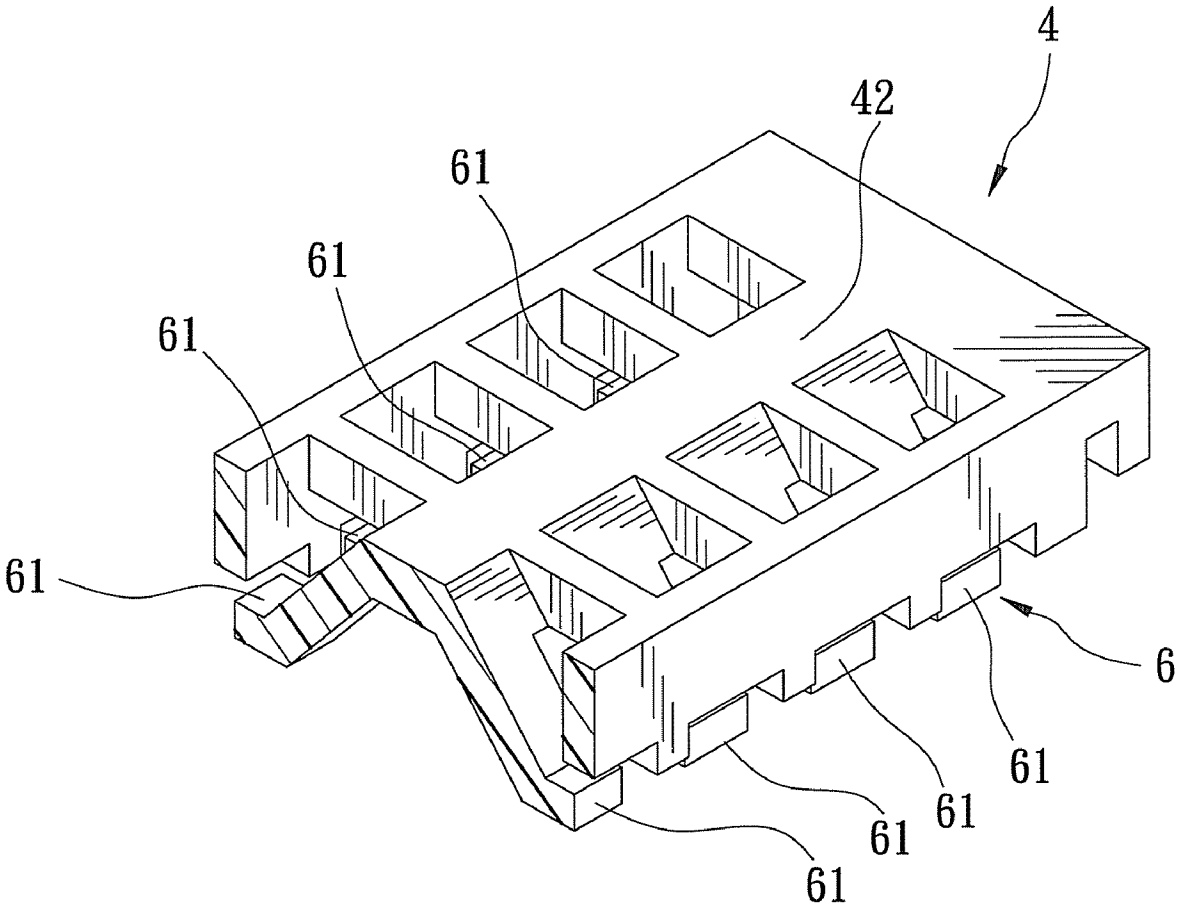
FIG. 3 is a fragmentary perspective partly cutaway view of the first preferred embodiment, illustrating a cover body and a resilient pusher unit.

As shown in FIGS. 2 and 3, the first preferred embodiment of a wire connecting device according to the present invention is adapted for connecting electrically a wire unit 2. The wire unit 2 includes a first wire 21, a second wire 22, a third wire 23, a fourth wire 24, a fifth wire 25, a sixth wire 26, and a seventh wire 27. Each of the wires 21-27 has an exposed conductor 28. The wire connecting device comprises a base seat 3, a cover body 4, a conducting unit 5, and a resilient pusher unit 6.

In this embodiment, the base seat 3 has a top surface 31 formed with four depressed mounting portions 32, each of which is formed with first and second recesses 321, 322. The base seat 3 further has a pair of engaging grooves 33.

The cover body 4 is coupled to the base seat 3 and covers the mounting portions 32. In this embodiment, the cover body 4 includes a pair of engaging hooks 41 (only one is visible in FIG. 2) for engaging respectively the engaging grooves 33 in the base seat 3, and a central member 42 extending in a direction transverse to that of the mounting portions 32.

The conducting unit 5 is disposed between the base seat 3 and the cover body 4. In this embodiment, the conducting unit 5 includes a pair of first conductive plates 51 and a second conductive plate 52 (see FIG. 2). The second conductive plate 52 is mounted on a pair of adjacent mounting portions 32 of the base seat 3, while the first conductive plates 51 are mounted on the other two mounting portions 32, respectively. Each of the first conductive plates 51 has first and second through holes 511, 512 corresponding respectively to the first and second recesses 321, 322 in the respective one of the mounting portions 32. The second conductive plate 52 has a third through hole 521 corresponding to the first recess 321 in one of the adjacent mounting portions 32, and a pair of fourth through holes 522 corresponding respectively to the second recesses 322 in the adjacent mounting portions 32. Each of the first, second, third, and fourth through holes 511, 512, 521, 522 is adapted for extension of the exposed conductor 28 of a respective one of the wires 21-27 of the wire unit 2 into the corresponding one of the first and second recesses 321, 322, as best shown in FIG. 6.

The resilient pusher unit 6 is provided between the cover body 4 and the conducting unit 5, and includes a plurality of pusher members 61. Each of the pusher members 61 extends obliquely and laterally outward from the central member 42 of the cover body 4 toward the base seat 3 for clamping a respective one of the wires 21-27 of the wire unit 2 between the pusher member 61 and the conducting unit 5.

Figure 4:
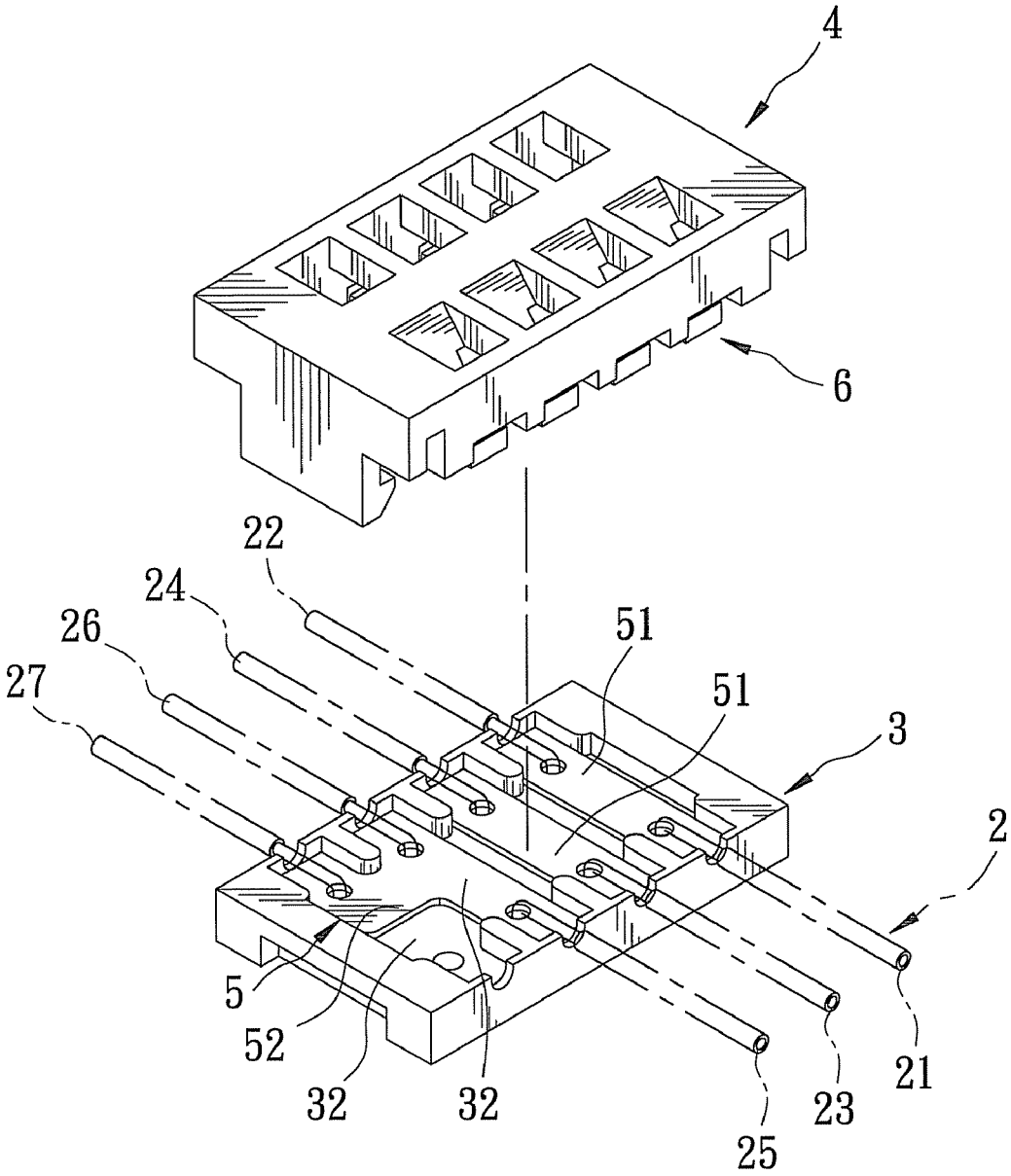
FIG. 4 is a partly exploded perspective view of the first preferred embodiment.
Figure 5:
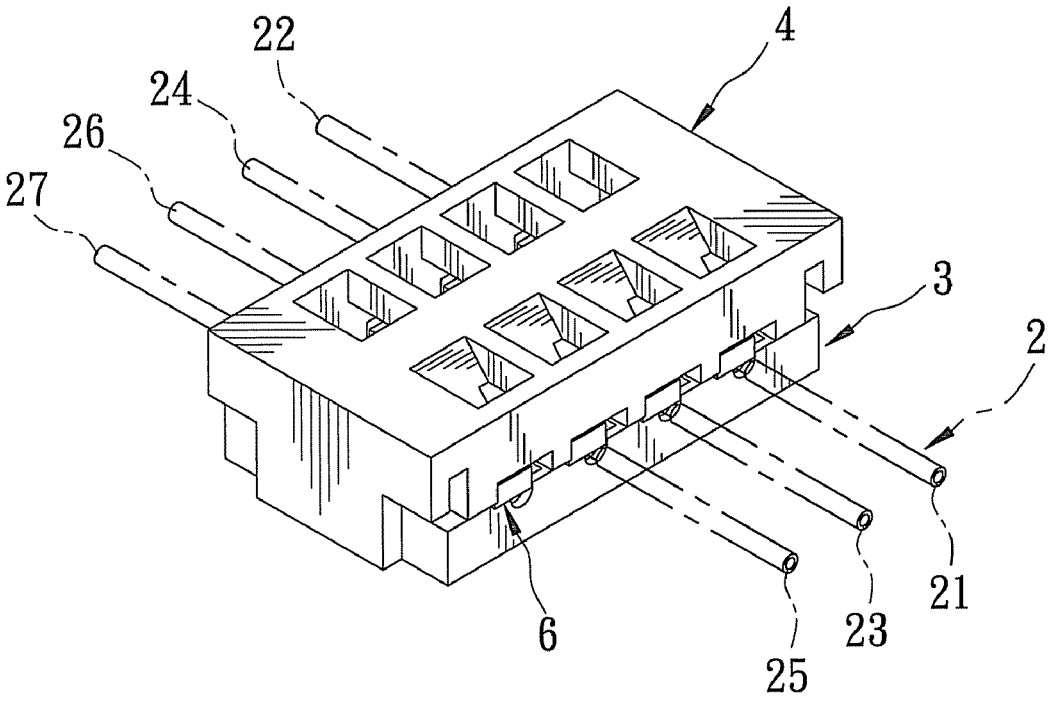
FIG. 5 is an assembled perspective view of the first preferred embodiment.
Figure 6:
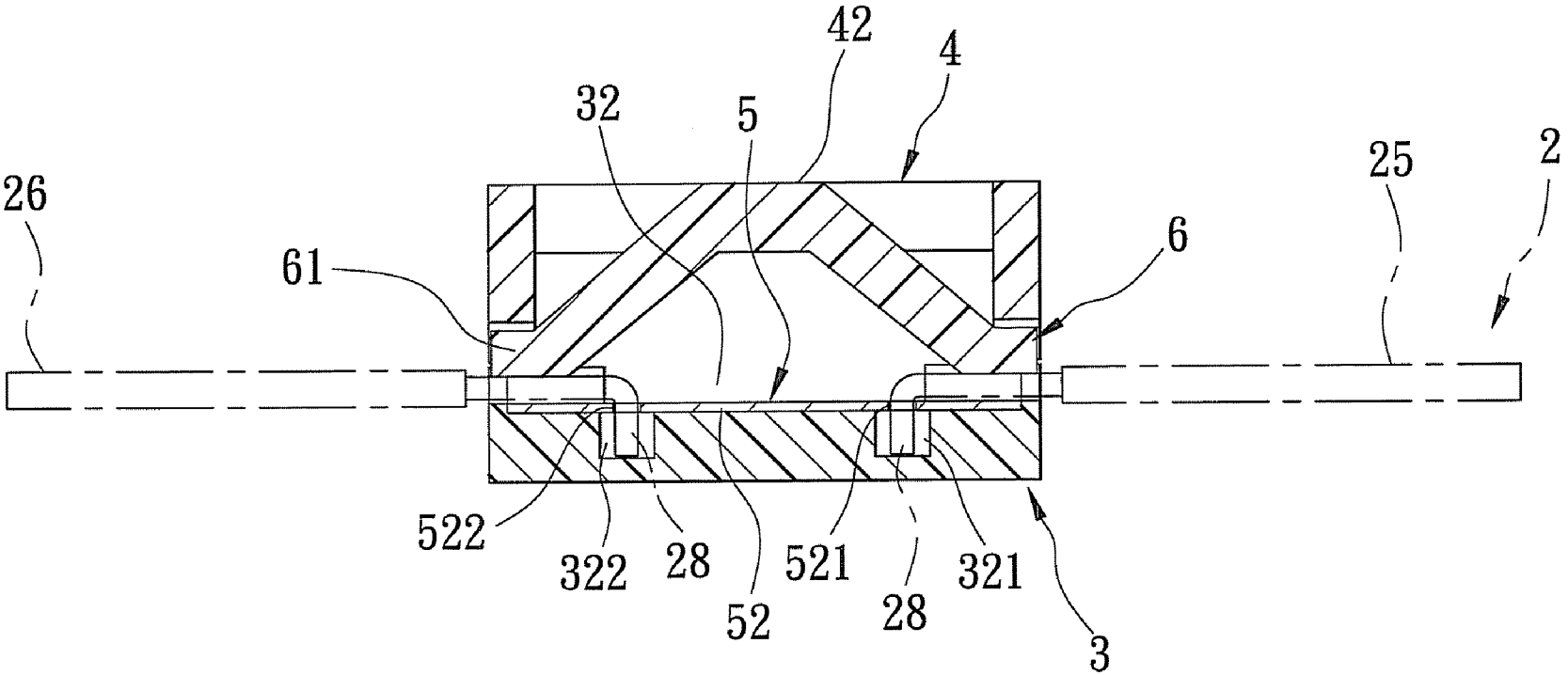
FIG. 6 is a schematic sectional view of the first preferred embodiment.

As shown in FIGS. 4 to 6, in use, the exposed conductor 28 of each of the first and second wires 21, 22 of the wire unit 2 is bent, the bent end of the exposed conductor 28 of the first wire 21 is extended through the first through hole 511 in one of the first conductive plates 51 of the conducting unit 5 into the first recess 321 of the corresponding one of the mounting portions 32 of the base seat 3, and the bent end of the exposed conductor 28 of the second wire 22 is extended through the second through hole 512 in the same first conductive plate 51 into the second recess 322 of the same mounting portion 32. Therefore, the conductive plate 51 is connected electrically to the first and second wires 21, 22. Similarly, the third and fourth wires 23, 24 can be connected electrically via the other conductive plate 51 in the same manner. Moreover, the fifth, sixth, and seventh wires 25, 26, 27 can be connected together in a manner similar to that for connecting the first and second wires 21, 22 by extending the bent exposed conductor 28 of the fifth wire 25 of the wire unit 2 through the third through hole 521 in the second conductive plate 52 into the first recess 321 of the corresponding one of the mounting portions 32, and by extending respectively the bent exposed conductors 28 of the sixth and seventh wires 26, 27 of the wire unit 2 through the fourth holes 522 in the second conductive plate 52 into the second recesses 322 of the corresponding adjacent mounting portions 32. Afterward, the cover body 4 is coupled to the base seat 3 via the engagement between the engaging hooks 41 of the cover body 4 and the engaging grooves 33 in the base seat 3, such that the pusher members 61 of the resilient pusher unit 6 abut resiliently and respectively against the wires 21-27 to prevent the wires 21-27 from being taken off from the first and second conductive plates 51, 52. Therefore, the conducting unit 5 can connect electrically one wire to another wire and can also connect electrically one wire to two other wires, thereby resulting in greater flexibility in use.

In this embodiment, the second conductive plate 52 is adapted for connecting one wire to two other wires.

However, the second conductive plate 52 can be designed for connecting one wire to more than two wires, and the sizes of the base seat 3 and the cover body 4 can be varied to fit the conducting unit 5.

Figure 7:
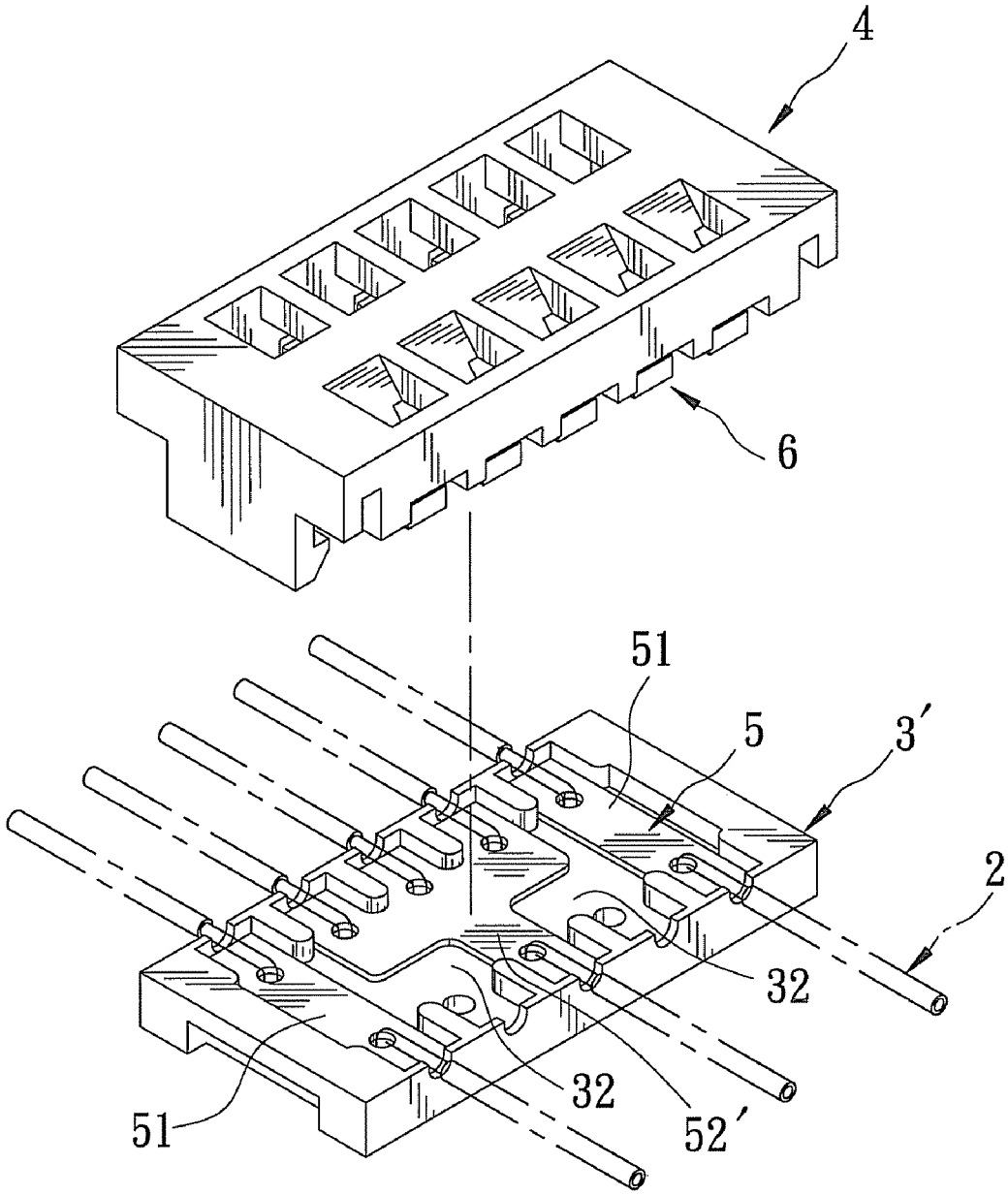
FIG. 7 is a partly exploded perspective view of the first preferred embodiment to illustrate a modified conducting unit thereof.

FIG. 7 illustrates a conducting unit 5 including a third conductive plate 52' adapted for connecting electrically one wire to three other wires in the same manner and mounted on a base seat 3'. Different from the abovementioned base seat 3 that has four mounting portions 32, the base seat 3' has five mounting portions 32 mounted with the third conductive plate 52' and two first conductive plates 51. The variation of the base seat 3 or 3', the cover body 4, and the conducting unit 5 or 5' further increases the flexibility of the wire connecting device of the invention.

Figure 8:
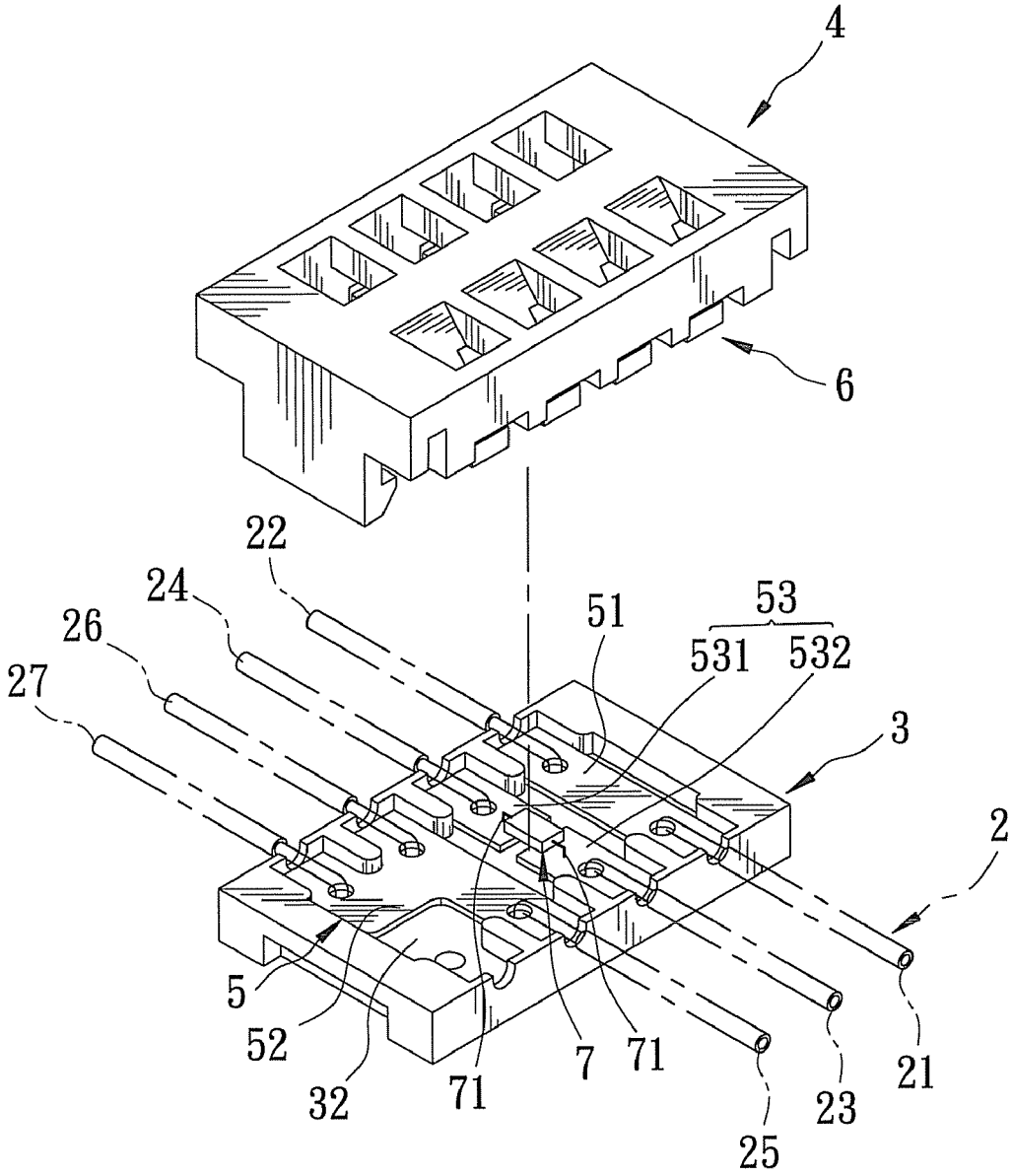
FIG. 8 is a partly exploded perspective view of a second preferred embodiment of a wire connecting device according to the invention.

As shown in FIG. 8, the second preferred embodiment of the wire connecting device according to the present invention has a structure similar to that of the first embodiment. The main difference between this embodiment and the previous preferred embodiment resides in the following. The conducting unit 5 has a fourth conductive plate 53 that includes separate first and second segments 531, 532 corresponding respectively to the first and second recesses 321, 322 of the associated mounting portion 32 of the base seat 3, and an electric component 7 that has a pair of connecting leads 71 connected respectively to the first and second segments 531, 532. The electric component 7 can be a fuse, a capacitor, a ferrite bead, or a resistor. The second preferred embodiment also has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A wire connecting device adapted for connecting electrically a plurality of wires, each of which has an exposed conductor, said wire connecting device comprising:

a base seat having at least one mounting portion that is formed with a first recess and at least one second recess;

a cover body coupled to said base seat and covering said at least one mounting portion;

a conducting unit disposed between said base seat and said cover body, and including at least one conductive plate that is mounted on said at least one mounting portion, and that has a first through hole corresponding to said first recess and at least one second through hole corresponding to said at least one second recess of said mounting portion, each of said first and second through holes being adapted for extension of the exposed conductor of a respective one of the wires into the corresponding one of said first and second recesses in such a manner that said at least one conductive plate is connected electrically to at least two of the wires; and a resilient pusher unit provided between said cover body and said conducting unit, and including a plurality of pusher members, each of which extends from said cover body toward said base seat for clamping each of the wires between a respective one of said pusher members and said conducting unit.

2. The wire connecting device as claimed in claim 1, wherein said base seat has a plurality of said mounting portions, at least one of said mounting portions being formed with said first recess and at least two of said second recesses, said conducting unit including a plurality of said conductive plates mounted respectively on said mounting portions, at least one of said conductive plates corresponding to said at least one of said mounting portions and having said first through hole that corresponds to said first recess and at least two of said second through holes that correspond respectively to said at least two second recesses.

3. The wire connecting device as claimed in claim 1, wherein said base seat further has a top surface formed with said at least one mounting portion.

4. The wire connecting device as claimed in claim 1, wherein one of said base seat and said cover body has a pair of engaging grooves, and the other of said base seat and said cover body includes a pair of engaging hooks engaging respectively said engaging grooves.

5. The wire connecting device as claimed in claim 1, wherein said at least one conductive plate of said conducting unit includes separate first and second segments corresponding respectively to said first recess and said at least one second recess of said at least one mounting portion of said base seat, and an electric component that has a pair of connecting leads connected respectively to said first and second segments.

6. The wire connecting device as claimed in claim 2, wherein one of said conductive plates of said conducting unit includes separate first and second segments corresponding respectively to said first recess and said at least one second recess of one of said mounting portions of said base seat, and an electric component that has a pair of connecting leads connected respectively to said first and second segments.

7. The wire connecting device as claimed in claim 1, wherein said cover body has a central member extending in a direction transverse to that of said at least one mounting portion in said base seat, each of said pusher members of said resilient pusher unit extending obliquely and laterally outward from said central member for abutting against a respective one of the wires.

* * * * *